US005226563A

United States Patent [19]

Coggiola

[11] Patent Number: 5,226,563

[45] Date of Patent: Jul. 13, 1993

[54] DEVICE FOR SPRAYING OR DISPENSING A FLUID, WITH IMPROVED ACTUATING SECURITY

[75] Inventor: Marcel Coggiola, Le Perreux, France

[73] Assignee: Valois (société anonyme), Le Neubourg, France

[21] Appl. No.: 868,243

[22] Filed: Apr. 14, 1992

[30] Foreign Application Priority Data

Apr. 16, 1991 [FR] France ..... 91 04618

[51] Int. Cl.[5] ..... B65D 35/28

[52] U.S. Cl. ..... 222/95; 222/153; 222/162; 222/183; 222/325; 222/386

[58] Field of Search ..... 222/162, 173, 182, 95, 222/153, 386, 386.5, 390, 507, 183, 325, 105; 604/214, 232, 275

[56] References Cited

U.S. PATENT DOCUMENTS 2,914,222 11/1959 Meshberg .
2,966,283 12/1960 Darvie .
4,226,339 10/1980 Landsman et al. ..... 222/182
4,962,868 10/1990 Borchard ..... 222/386 X

FOREIGN PATENT DOCUMENTS 921078 10/1954 Fed. Rep. of Germany .
619067 3/1927 France ..... 222/390
2099933 3/1972 France .
2231094 11/1990 United Kingdom ..... 222/390

*Primary Examiner*—Gregory L. Huson
*Attorney, Agent, or Firm*—Sughrue, Mion, Zinn, Macpeak and Seas

[57] ABSTRACT

A fluid spraying or dispensing device has a sheath 1 extending between an open first end 4 and a second end 5 provided with an end wall 6 which is pierced by at least one hole 7. A fluid tank 10 is slidably mounted inside the sheath and is provided with a fluid ejection device 13 controlled by a push rod 15 secured to the sheath, and a cover 30 is adapted to be slidably engaged on the second end of the sheath. The cover includes at least one projection 33 adapted to penetrate through the hole in the end wall of the sheath to enable the push rod to be actuated by pressing against the end wall of the tank.

10 Claims, 3 Drawing Sheets

DEVICE FOR SPRAYING OR DISPENSING A FLUID, WITH IMPROVED ACTUATING SECURITY

The present invention relates to a device for spraying or dispensing a fluid, with improved actuating security. More particularly, the present invention applies to a device including a manually-actuated aerosol type valve or pump for spraying a fluid such as a pharmaceutical, a cosmetic, or a perfume. It is desirable to ensure that such a device cannot be actuated inadvertently, particularly if the fluid is expensive or dangerous.

BACKGROUND OF THE INVENTION

Document U.S. Pat. No. 2,914,222 describes such a device, comprising:

a sheath having a first end provided with a spray nozzle and an open second end; and a fluid tank slidably mounted in said sheath, said tank having a valve that communicates with said spray nozzle and an end wall disposed close to the open second end of the sheath.

In that device, the valve is actuated by pressing against the end wall of the fluid tank by means of a finger, either directly or via an actuator member engaged in the open second end of the sheath. If actuation is performed by pressing directly against the end wall of the tank, it is possible that a projecting outside element may press accidentally against the end wall of the tank, thereby actuating the device, e.g. while it is being transported. Furthermore, while the device is being handled, it is also possible to press a finger inadvertently against the end wall, particularly if the device is in the hands of a child. In the case where actuation is performed by means of an actuator member, Document U.S. Pat. No. 2,914,222 provides for said member to have a lateral lug that co-operates with a slot at the open second end of the sheath for the purpose of locking the device when the lug is not in line with the slot. However, it is to be feared that the great majority of users will not bother to move the lug away from the slot each time they have finished using the device, and as a result the device will not be locked and the problem of actuating security remains unsolved.

An object of the present invention is to solve this technical problem.

SUMMARY OF THE INVENTION

The present invention therefore provides a device for spraying or dispensing a fluid, the device comprising:

a sheath extending axially between an open first end and a second end provided with an end wall which is pierced by at least one hole;

a fluid tank mounted to slide axially inside said sheath and extending between an end wall close to the end of the sheath and fluid ejection means, said fluid ejection means having an axial push rod enabling fluid to be ejected and disposed close to the open first end of the sheath;

a pusher endpiece mounted in the open first end of the sheath, and including an outlet channel adapted to receive the push rod of the ejection means; and a cover comprising an end wall from which there projects an outside skirt adapted to be engaged on the open first end of the sheath;

wherein:

the skirt of the cover is adapted to engage slidably over the second end of the sheath; and the cover includes at least one projection extending from its end wall and surrounded by the skirt of said cover, and adapted to penetrate through the hole in the end wall of the sheath when the skirt of the cover is engaged on the second end of the sheath, thereby enabling the push rod to be actuated.

It is thus the cover that serves to actuate the device by pressing against the base of the tank, and so long as the cover is covering the pusher endpiece it is practically impossible to actuate the device. It can be expected that most users will put the cover back on the pusher endpiece each time they have finished using the device since that is a natural action that is almost a reflex.

The hole in the end wall of the sheath may be of a shape such that the largest circle which can be inscribed in said hole has a diameter of less than about 15 mm, such that a human finger cannot pass easily through said hole.

The shape of the hole in the end wall of the sheath may possibly be such that the largest circle that can be inscribed in said hole has a diameter of less than about 10 mm or where appropriate less than about 5 mm. In a variant, the hole in the end wall of the sheath may be of a shape such that the largest circle that can be inscribed in said hole has a diameter of not more than about 25 mm, and in which, when the push rod of the ejection means is received in the outlet channel of the pusher endpiece, the end wall of the tank is set back from the end wall of the sheath by a distance greater than half said diameter. Advantageously, said projection formed on the end wall of the cover includes at least one cylindrical wall adapted to be engaged in sealed manner on the outlet end of the pusher endpiece when the cover is engaged on the open first end of the sheath. Said projection on the cover may have a shape that is not circularly symmetrical and the hole in the end wall of the sheath may be complementary in shape, such that said projection can be inserted into said hole only if said projection and said hole are in correspondence, said projection thus constituting a key that prevents a child inserting said projection easily into said hole.

In one embodiment, the push rod of the ejection means is separated from the outlet of the pusher endpiece before the first actuation of the push rod, said push rod being received in said outlet channel during said first actuation, and the tank being a sliding fit in the sheath.

BRIEF DESCRIPTION OF THE DRAWINGS

Embodiments of the invention are described by way of example with reference to the accompanying drawings, in which.

DETAILED DESCRIPTION

Figure 1:
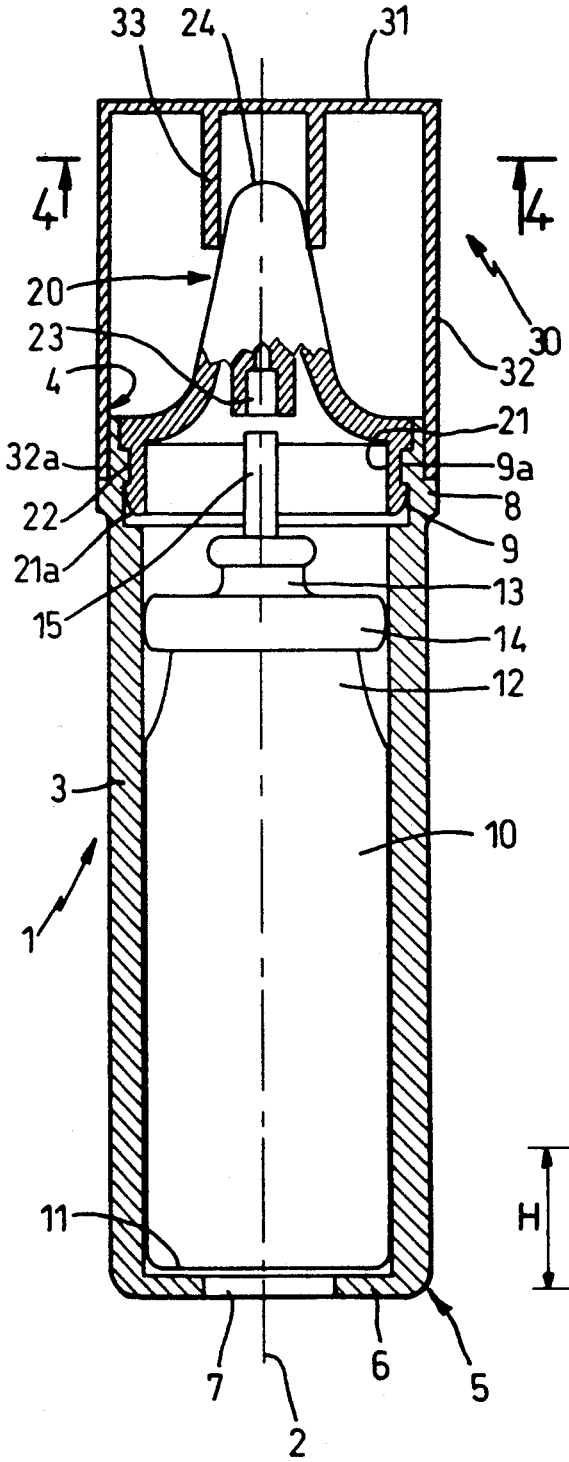
FIG. 1 is a view partly in section showing a device constituting a first embodiment of the invention before its first use.

With reference to FIG. 1, the device forming an embodiment of the invention includes a cylindrical sheath 1 about an axis of revolution 2 and suitable for being molded out of plastic. The sheath 1 has a cylindrical side wall 3 which extends between an open first end 4 and a second end 5 provided with an end wall 6 that is pierced by a central circular hole 7. The diameter of the circular hole 7 is small enough to make it difficult for a user to push a finger through the hole: for example the diameter may be about 15 mm or less. In the vicinity of its open first end 4, the side wall 3 also has an outside rim 8, and an end-portion 9 of greater inside diameter, and including an inside rim 9*a*.

A fluid tank 10 is mounted to slide axially inside the sheath 1. The tank 10 extends between an end wall 11 and a neck 12 with fluid expulsion means 13 mounted thereon. The fluid expulsion means may be mounted on the neck 12 by means of a crimped metal capsule 14, for example. The expulsion means 13 may be a manually-actuated pump or an aerosol valve. In all cases, the expulsion means 13 includes a conventional push rod 15 which enables the fluid to be expelled when it is pushed into the expulsion means 13, and which projects from the expulsion means 13 towards the open first end 4 of the sheath.

A pusher endpiece 20 which may be made of molded plastic is also mounted in the open first end 4 of the sheath 1. The pusher endpiece 20 is circularly symmetrical about the axis 2 and it may be mounted in the open first end 4 of the sheath 1 by snap-fastening or by any other means, and it is advantageously mounted in such a manner as to prevent it from being dismounted. For example, the pusher endpiece 20 may include a cylindrical skirt 21 having an inside diameter that is substantially equal to the inside diameter of the side wall 3 of the sheath, said skirt 21 including an outside peripheral groove 22 in which the inside rim 9*a* of the sheath 1 can be snapped. Advantageously, the skirt 21 includes an outside chamfer 21*a* on its free end so as to facilitate snap-fastening. In conventional manner, the pusher endpiece 20 further includes an outlet channel 23 which opens to the outside of the pusher endpiece and in which the push rod 15 can be engaged as a push fit. In this particular example, the outlet channel 23 opens axially to the outside via a central outlet end 24: nevertheless, the pusher endpiece 20 could have any other conventional shape without going beyond the ambit of the present invention, and in particular, it could have a lateral outlet instead of an axial outlet.

Finally, the device includes a cover 30 which may also be made of molded plastic. The cover 30 has an end wall 31 from which an outside skirt 32 projects to a free end 32*a*. In the storage position as shown in FIG. 1, the cover 30 is engaged as a push fit on the open first end 4 of the sheath 1 until it comes into abutment with the outside rim 8. The cover 30 thus covers the pusher endpiece 20. In addition, the cover 30 includes a central inside projection 33 which in this case is in the form of a cylindrical wall whose outside diameter is equal to or less than the inside diameter of the hole 7, which cylindrical wall projects axially from the end wall 31 at the center of the outside skirt 32. Advantageously, the cylindrical wall 33 engages in sealed manner on the pusher endpiece 20 when the cover 30 covers said pusher endpiece, thereby isolating the outlet end 24 of said pusher endpiece so as to protect it from any external pollution.

Figure 3:
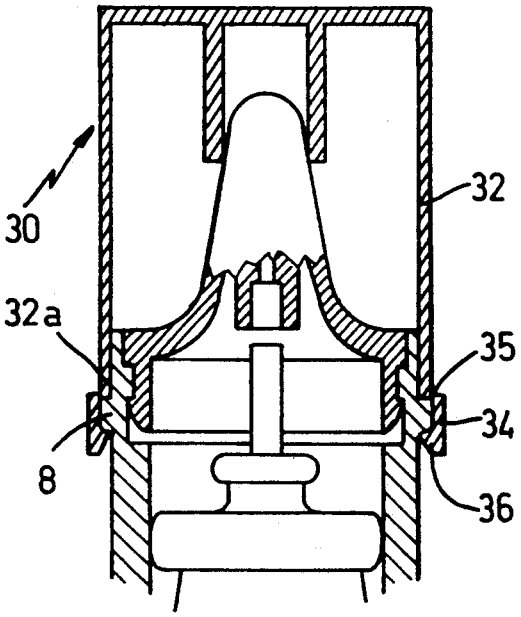
FIG. 3 is a fragmentary view, partly in section, showing a variant of the FIG. 1 device before its first use.

The cover 30 may optionally be provided with a tamperproofing ring 34 as shown in FIG. 3. The ring 34 is connected to the free end 32*a* of the skirt 32 of the cover via weak bridges of material 35 and it includes inwardly directed catches 36 for snapping behind the outside rim 8 of the sheath 1. Once snapped into position, the ring 34 holds the cover 30 in the storage position shown in FIG. 3 and said cover cannot be removed without breaking the bridges of material 35 which thus prove that the device has never been used.

Before the device is used for the first time, the push rod 15 of the fluid ejection means 13 need not be engaged in the outlet channel 23 of the pusher endpiece 20, thereby further contributing to avoiding untimely actuation. Under such circumstances, it is nevertheless preferable for the tank 10 to slide with a small amount of friction inside the side wall 3 of the sheath 1 to prevent the tank 10 rattling inside the sheath 1 before the push rod 15 is engaged in the channel 23.

Figure 2:
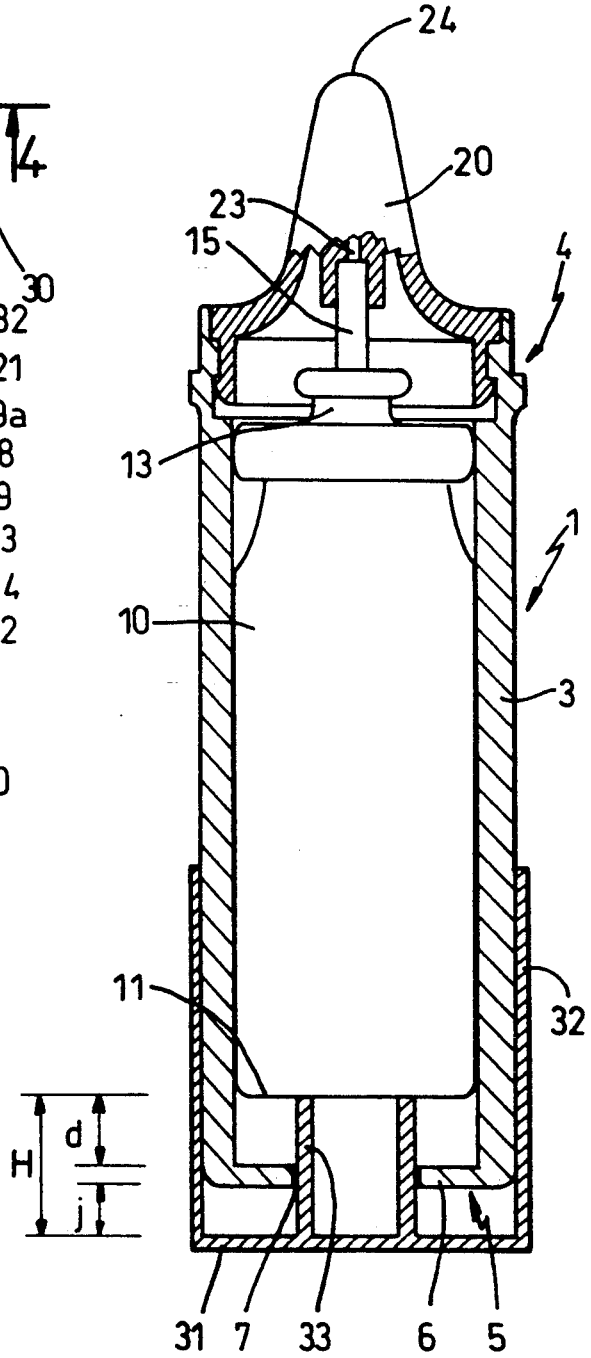
FIG. 2 is a view partly in section of the FIG. 1 device ready to be actuated.

When the user seeks to make use of the device of the invention, the cover 30 needs to be removed from the first end 4 of the sheath 1 and engaged on the second end 5 thereof, as shown in FIG. 2. The outside skirt 32 of the cover then surrounds the sheath 1 and the cylindrical wall 33 penetrates through the hole 7 in the end wall 6 of the sheath until it comes into abutment against the end wall 11 of the tank 10. The outside diameter of the cylindrical side wall 3 between the outside rim 8 and its second end 5 is advantageously slightly less than the outside diameter of said wall between the outside rim 8 and its first end 4, such that the skirt 32 of the cover slides freely over the sheath 1 when the cover 30 is placed over the second end 5 of the sheath, whereas the skirt 32 is a push fit on the sheath 1 when the cover 30 is covering the pusher endpiece 20.

The device is actuated by pressing simultaneously on the pusher endpiece 20 and on the end wall 31 of the cover 30, thereby causing the cylindrical wall 33 to press against the end wall 11 of the tank 10 and thus displacing the tank 10 towards the pusher endpiece 20. On the first occasion the device is actuated, and if the push rod 15 of the ejection means 13 is not initially engaged in the outlet channel 23 of the pusher endpiece, this movement begins by putting said push rod 15 into place in said outlet channel 23 where it is engaged as a push fit. Thereafter, the push rod 15 is held in the channel 23 by friction. However, in all cases, the main effect of moving the tank 10 towards the pusher endpiece 20 is to cause the push rod 15 to be pushed into the ejection means 13 against the thrust of resilient means conventionally included in the ejection means 13, thereby causing fluid to be ejected via the outlet end 24 of the pusher endpiece 20.

When the user stops pushing, the said resilient means of the ejection means 13 pushes back the tank 10 away from the pusher endpiece 20 until it takes up a reset position as shown in FIG. 2. If there is a small amount of friction between the tank 10 and the sheath 1, then that friction must be small enough to avoid impeding the movement of the tank inside the sheath 1.

To make such actuation possible, the height H of the cylindrical wall 33 on the end wall of the cover 30 must be sufficient so that when in the rest position as shown in FIG. 2, with the push rod 15 engaged in the outlet channel 23 and with the cylindrical wall 33 in abutment against the end wall 11 of the tank 10, there remains clearance J between the end wall 6 of the sheath 1 and the end wall 31 of the cover 30, corresponding to not less than the actuating stroke of the push rod 15.

When the user has finished using the device, the cover 30 is put back on the pusher endpiece 20. Because of the small diameter of the hole 7, it is then almost certain that the device cannot be actuated accidentally, e.g. while being handled. The end wall 11 of the tank 10 may optionally be set back from the end wall 6 of the sheath 1 by a distance d which is sufficient to ensure that a child's finger cannot press against the end wall 11 after passing through the hole 7. Under such circumstances, the hole 7 may optionally be larger. For example, the hole 7 in the end wall 6 could be of a shape such that the diameter of the largest circle that can be inscribed in said hole is not greater than about 25 mm, while the distance d may be greater than half said diameter.

Figure 4:
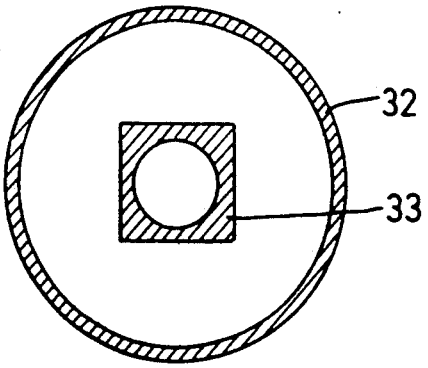
FIG. 4 is a cross-section view through another variant of the cover for the FIG. 1 device, the section being taken line 4—4 of FIG. 1.
Figure 5:
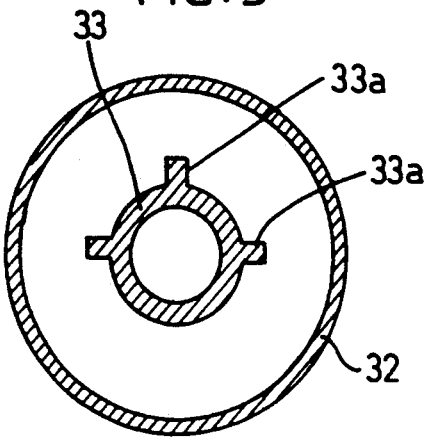
FIG. 5 is a cross-section view through another variant of the cover of the FIG. 1 device, the section being taken on line 4—4 of FIG. 1.

In order to prevent a young child engaging the cover 30 on the second end 5 of the sheath 1 by chance, where the child would then run the risk of actuating the device, the outside shape of the wall 33 need not be circularly symmetrical about the axis 2, and the hole 7 may be complementary in shape, such that the wall 33 can be engaged in the hole 7 only when said wall 33 and said hole 7 are placed in exact correspondence by rotation about the axis 2. The wall 33 thus acts as a key. For example, as shown in FIG. 4, the outside shape of the wall 33 could be square in section, or else as shown in FIG. 5, it could have outside ribs 33*a* suitable for engaging in corresponding notches in the end wall 6 of the sheath 1. Under such circumstances, it is advantageous for the ribs 33*a* to be distributed non-uniformly around the wall 33 so that said wall 33 can be inserted into the hole 7 in only one angular position about the axis 2.

Figure 6:
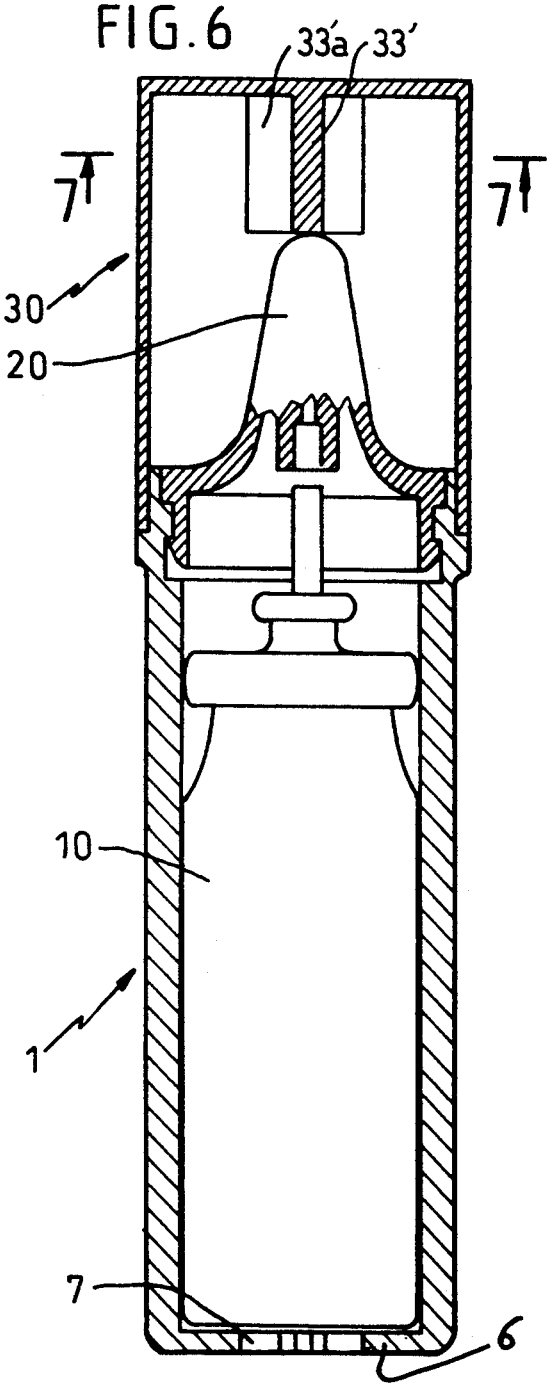
FIG. 6 is a view, partly in section, of another variant of the FIG. 1 device.
Figure 7:
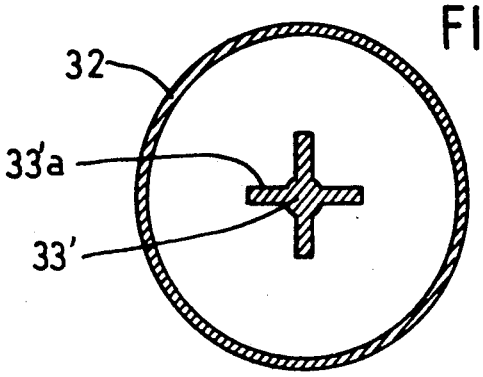
FIG. 7 is a cross-section view through the cover of the FIG. 6 device taken on line 7—7 of FIG. 6.

In a variant, as shown in FIGS. 6 and 7, the wall 33 may be replaced by a solid projection 33' such as a central rod which may be provided with ribs 33'*a* that are distributed uniformly or non-uniformly around the rod 33'. The shape of the projection 33' may optionally be different from that of a rod, for example it may be constituted by a plurality of rods and/or a plurality of ribs, without thereby going beyond the ambit of the present invention.

The end wall 6 of the sheath 1 is then pierced by one or more holes 7 that are complementary to the projection(s) 33', and that may therefore be very narrow, thereby providing even greater protection against accidental actuation. The shape and size of the hole 7 may be such that the largest circle that can be inscribed in said hole 7 has a diameter of less than 15 mm, and preferably less than 10 mm or even less than 5 mm. It should be observed that the concept of the largest circle that can be inscribed in a hole does not require the hole(s) 7 to be circular; for example, if a hole 7 is square in section, then the diameter of the largest circle that can be inscribed therein is equal to the side of the square, and if a hole 7 is rectangular in shape, then the diameter of the largest circle that can be inscribed therein is equal to the short side of the rectangle, while if the hole is elliptical in section, then the diameter of the largest inscribed circle is equal to the length of the short axis of the ellipse, etc.

The security device of the invention may be associated with other devices, e.g. a counter for counting the number of measured doses of fluid that have been ejected.

Figure 8:
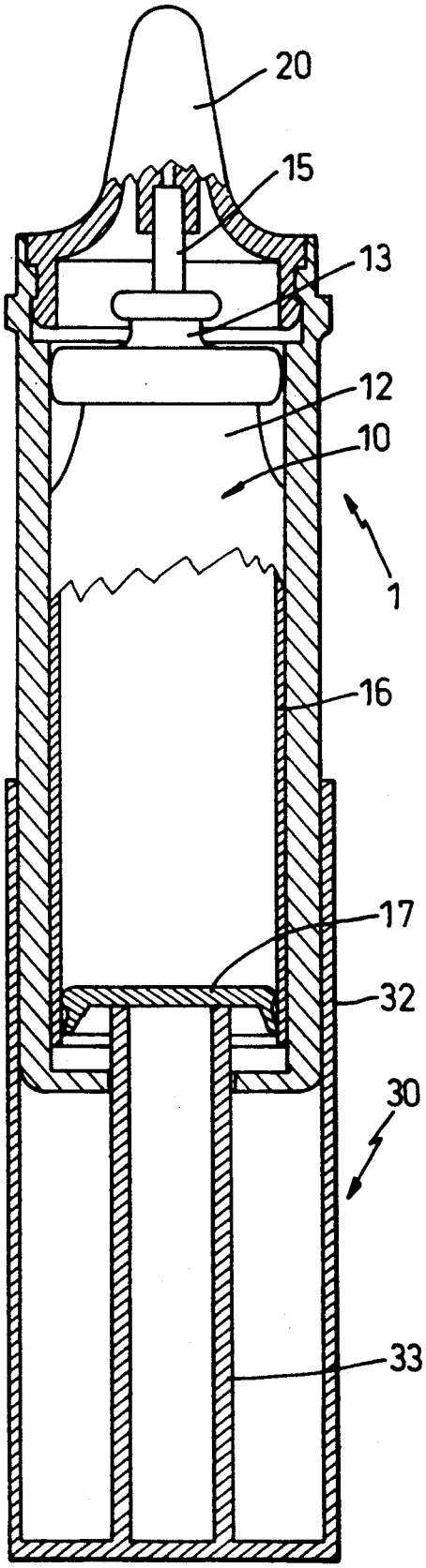
FIG. 8 is a view partly in section of another variant of the FIG. 1 device shown ready to be actuated.
Figure 9:
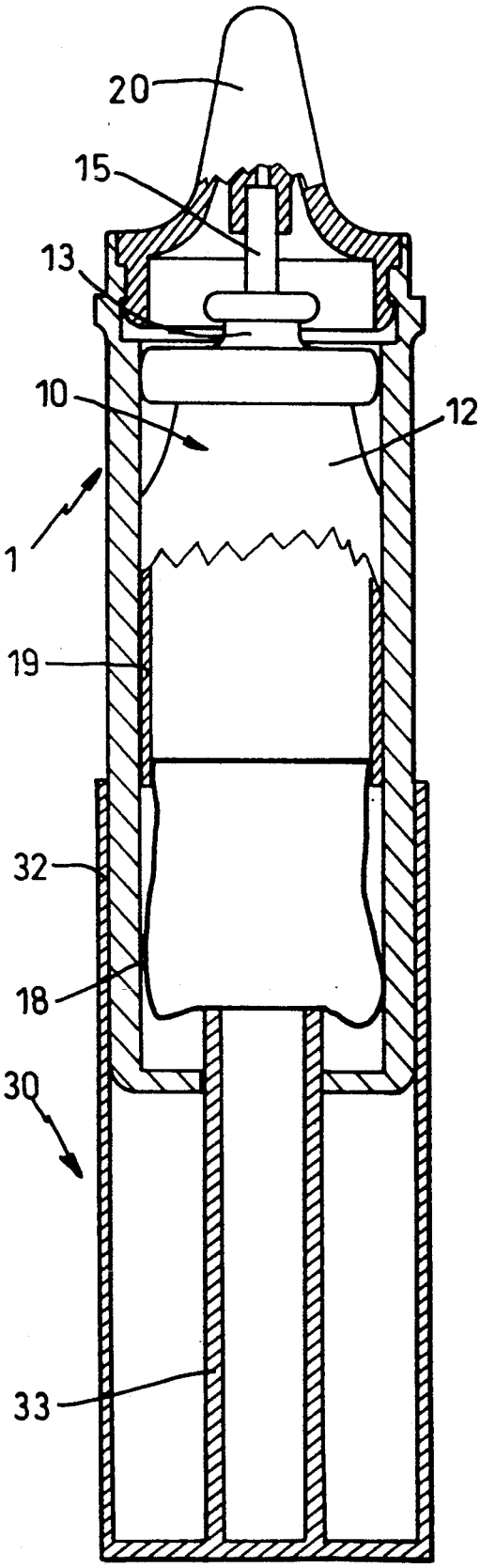
FIG. 9 is a view partly in section of another variant of the FIG. 1 device shown ready to be actuated.

If the expulsion means 13 is a spray pump, then it may operate either with or without an air intake, i.e. air may be caused to enter the tank 10 to replace the fluid it contains as the fluid is consumed, or else air may be prevented from entering the tank. If air is prevented from entering, it may be advantageous for the tank to be deformable so as to prevent the underpressure in the tank becoming excessive. FIGS. 8 and 9 show two particular examples of such tanks associated with the device of the invention.

In FIG. 8, the tank 10 comprises a cylindrical side wall 16 in which a piston 17 constituting the end wall of said tank is slidably mounted. The cylindrical wall 33 or some other projection 33' presses against the piston 17 so that each time the device is actuated, said cylindrical wall 33 urges the piston 17 towards the neck 12 of the tank, thereby creating overpressure inside the tank. Since the fluid contained in said tank is incompressible, the overpressure gives rise to thrust exerted on the pump 13 towards the endpiece 20, thereby causing said pump to be actuated. This may be advantageous under circumstances where the piston 17 slides inside the side wall 16 with a certain amount of friction such that a small amount of underpressure may have remained inside the tank since the last time it was actuated. The thrust of the wall 33 eliminates said underpressure, and overpressure is established inside the tank 10 while the device is being actuated. When the user releases the device, a portion of said overpressure remains, again because of the friction between the side wall 16 and the piston 17, such that suction of the fluid into the pump 13 is improved.

It may be observed that the height of the cylindrical wall 33 and of the skirt 32 of the cover 30 is considerably increased compared with the device shown in FIGS. 1 and 2. The said wall 33 can thus press against the piston 17 throughout the entire stroke of said piston 17 until it reaches the neck 12 of the tank, i.e. until the tank of fluid has been emptied.

In FIG. 9, the tank 10 includes a rigid cylindrical side wall 19 on which a flexible wall 18 constituting a bag is assembled, said bag forming the end wall of the tank 10. The flexible wall 18 is assembled to the rigid wall 19 in sealed manner by welding, gluing, or any other means. The flexible wall 18 may optionally be integrally formed with the rigid wall 19. As shown in FIG. 9, the flexible wall 18 may optionally extend outside the rigid cylindrical wall 19 when the tank is full, and it may then be moved progressively inside said wall 19 as the fluid contained inside the tank is consumed. The wall 33 or any other projection 33' may bear against the flexible wall 18 in the actuation position such that each time the device is actuated, said cylindrical wall 33 urges the flexible wall 18 towards the neck 12 of the tank, thereby establishing overpressure inside said tank. Since the fluid contained in said tank is incompressible, said overpressure gives rise to thrust which is exerted on the pump 13 towards the endpiece 20, thereby causing said pump to be actuated. Because the cylindrical wall 33 bears directly against the flexible wall, deformation of the flexible wall 18 is facilitated, which is particularly important if the flexible wall is somewhat rigid and might otherwise establish troublesome underpressure inside the tank 10. As in the case shown in FIG. 8, if such underpressure is established while the fluid is being sucked out via the pump 13, said underpressure is eliminated by the overpressure due to the wall 33 pressing against the wall 18 on the next occasion the device is actuated. As in FIG. 8, the height of the wall 33 and of the skirt 32 of the cover 30 is increased so that the wall 33 can continue to press against the flexible wall 18 after it has been pushed inside the rigid wall 19.

I claim:

1. A device for spraying or dispensing a fluid, the device comprising:

a sheath extending axially between an open first end and a second end provided with an end wall which is pierced by at least one hole;

a fluid tank mounted to slide axially inside said sheath and extending between an end wall close to the end of the sheath and having fluid ejection means, said fluid ejection means having an axial push rod enabling fluid to be ejected and disposed close to the open first end of the sheath;

a pusher endpiece mounted in the open first end of the sheath, and including an outlet channel adapted to receive the push rod of the ejection means; and a cover comprising an end wall from which there projects an outside skirt adapted to be engaged on the open first end of the sheath;

wherein:

the skirt of the cover is adapted to engage slidably over the second end of the sheath; and the cover includes at least one projection extending from its end wall and surrounded by the skirt of said cover, and adapted to penetrate through the hole in the end wall of the sheath when the skirt of the cover is engaged on the second end of the sheath, thereby enabling the push rod to be actuated.

2. A device according to claim 1, in which the hole in the end wall of the sheath is of a shape such that the largest circle which can be inscribed in said hole has a diameter of less than 15 mm, such that a human finger cannot pass easily through said hole.

3. A device according to claim 1, in which the hole in the end wall of the sheath is of a shape such that the largest circle which can be inscribed in said hole has a diameter less than 10 mm.

4. A device according to claim 1, in which the hole in the end wall of the sheath is of a shape such that the largest circle which can be inscribed in said hole has a diameter less than 5 mm.

5. A device according to claim 1, in which the hole in the end wall of the sheath is of a shape such that the largest circle that can be inscribed in said hole has a diameter of not more than 25 mm, and in which, when the push rod of the ejection means is received in the outlet channel of the pusher endpiece, the end wall of the tank is set back from the end wall of the sheath by a distance greater than half said diameter.

6. A device according to claim 1, in which said projection formed on the end wall of the cover includes at least one cylindrical wall adapted to be engaged in sealed manner on the outlet end of the pusher endpiece when the cover is engaged on the open first end of the sheath.

7. A device according to claim 1, in which said projection of the cover is not circularly symmetrical, and in which the hole in the end wall of the sheath is complementary in shape, such that said projection can be inserted into said hole only if said projection and said hole are in correspondence, said projection thus constituting a key that prevents a child inserting said projection easily into said hole.

8. A device according to claim 1, in which the tank includes a cylindrical side wall in which a piston forming the end wall of said tank is slidably received, said projection of the cover being adapted to press against said piston during actuation of the device.

9. A device according to claim 1, in which the tank includes a rigid wall and a flexible wall forming the end wall of said tank, said projection of the cover being adapted to press against said flexible wall during actuation of the device.

10. A device according to claim 1, in which the push rod of the ejection means is separated from the outlet of the pusher endpiece before the first actuation of the push rod, said push rod being received in said outlet channel during said first actuation, and the tank being a sliding fit in the sheath.

* * * * *